US011945635B2

(12) United States Patent
Black et al.

(10) Patent No.: US 11,945,635 B2
(45) Date of Patent: Apr. 2, 2024

(54) FLEXIBLE CONTAINER WITH HANDLES

(71) Applicant: Dow Global Technologies LLC, Midland, MI (US)

(72) Inventors: Marc S. Black, Midland, MI (US); Liangkai Ma, Midland, MI (US); Simon Jespersen, Rueschlikon (CH); Muhammad Ali Siddiqui, Waedenswil (CH); Chad V. Schuette, Saginaw, MI (US); Brian W. Walther, Clute, TX (US); Fabrice Digonnet, Faellanden (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 17/614,798

(22) PCT Filed: May 28, 2020

(86) PCT No.: PCT/US2020/034814

§ 371 (c)(1),
(2) Date: Nov. 29, 2021

(87) PCT Pub. No.: WO2020/243229

PCT Pub. Date: Dec. 3, 2020

(65) Prior Publication Data

US 2022/0227556 A1 Jul. 21, 2022

Related U.S. Application Data

(60) Provisional application No. 62/855,314, filed on May 31, 2019.

(51) Int. Cl.

| | |
|---|---|
| ***B65D 75/56*** | (2006.01) |
| ***B65D 75/58*** | (2006.01) |
| *B65D 75/00* | (2006.01) |

(52) U.S. Cl.
CPC ..... *B65D 75/563* (2013.01); *B65D 75/5861* (2013.01); *B65D 75/008* (2013.01)

(58) Field of Classification Search
CPC . B65D 75/563; B65D 75/5861; B65D 75/008
(Continued)

(56) References Cited

U.S. PATENT DOCUMENTS 4,394,936 A * 7/1983 Shavit ..... B65D 35/12 493/213
4,484,351 A * 11/1984 de Leeuwe ..... A61J 1/10 222/107

(Continued)

FOREIGN PATENT DOCUMENTS

JP 2006-176138 A 7/2006

*Primary Examiner* — Peter N Helvey
(74) *Attorney, Agent, or Firm* — Boyle Fredrickson, S.C.

(57) ABSTRACT

The present disclosure provides a flexible container (10). In an embodiment, the flexible container includes a front panel (22), a rear panel (24), a first gusseted side panel (18), and a second gusseted side panel (20). The gusseted side panels adjoin the front panel and the rear panel along peripheral seals (41) to form a chamber. The panels form (i) a top portion, (ii) a body portion, and (iii) a bottom portion. The top portion comprises a neck (27) and a fitment (30) in the neck. The front panel comprises a front handle (82) extending therefrom and the rear panel comprises a rear handle (84) extending therefrom. The front handle and the rear handle are in opposing relation to each other, the front handle and the rear handle extending over the first gusseted side panel.

21 Claims, 5 Drawing Sheets

(58) Field of Classification Search
USPC ..... 383/10
See application file for complete search history.

(56) References Cited

U.S. PATENT DOCUMENTS 4,911,562 A * 3/1990 Mazzeschi ..... B65D 33/1658 224/616
5,783,638 A 7/1998 Lai et al.
6,302,300 B1 * 10/2001 Bosch ..... B29D 23/20 222/107
8,201,688 B2 * 6/2012 Burfiend ..... A47K 5/18 206/823
8,231,029 B2 * 7/2012 Peer ..... B65D 75/5883 220/754
8,348,509 B2 * 1/2013 Wilkes ..... B65D 75/28 383/906
8,840,305 B2 * 9/2014 Wilkes ..... B65D 75/566 383/906
9,573,737 B2 * 2/2017 Bonekamp ..... B65D 35/28
9,856,063 B1 * 1/2018 Schulz ..... B65D 31/10
9,908,668 B2 * 3/2018 Wilkes ..... B65D 75/5883
10,106,301 B2 * 10/2018 Schulz ..... B65D 75/566
10,377,555 B2 * 8/2019 Gaston ..... B65D 75/5883
11,155,394 B2 10/2021 Black et al.
11,198,550 B2 12/2021 Black et al.
11,479,398 B2 * 10/2022 Wilkes ..... B65D 75/5883
2007/0047851 A1 * 3/2007 Sato ..... B29C 66/3452 383/906
2009/0097779 A1 * 4/2009 Branch ..... B65D 33/2508 383/207
2009/0162133 A1 6/2009 Haefele et al.
2011/0019945 A1 * 1/2011 Sagara ..... B65D 1/0238 383/105
2011/0069908 A1 3/2011 Wilkes et al.
2013/0121622 A1 5/2013 Wilkes et al.
2014/0112599 A1 4/2014 Martin et al.
2016/0152381 A1 * 6/2016 Kreymborg ..... B65D 33/08 383/10
2016/0176579 A1 * 6/2016 Brauer ..... B31B 70/00 493/227
2022/0362073 A1 * 11/2022 Shimizu ..... A61F 13/55115
2022/0396870 A1 * 12/2022 Suzuki ..... B65D 65/40
2023/0159229 A1 * 5/2023 Marks ..... B65F 1/0013 383/7

* cited by examiner

FLEXIBLE CONTAINER WITH HANDLES

BACKGROUND

Known are flexible containers that are used to store, transport, and dispense a flowable material. Large, gusseted flexible containers having handles on the top and the bottom of the container are becoming increasingly available. The requisite two-hand operation of the dual handle container has several drawbacks. The non-rigid and pliable nature of the flexible container requires two-hand operation to avoid spillage while dispensing. The operator's care and attention is further required during the entire dispensing sequence to ensure the container handle does not get in the way of the dispensing flow and invoke spillage.

The art recognizes the need for flexible containers with improved handling and dispensing control.

SUMMARY

Disclosed herein is a flexible container. In an embodiment, the flexible container includes a front panel, a rear panel, a first gusseted side panel, and a second gusseted side panel. The gusseted side panels adjoin the front panel and the rear panel along peripheral seals to form a chamber. The panels form (i) a top portion, (ii) a body portion, and (iii) a bottom portion. The top portion comprises a neck and a fitment in the neck. The front panel comprises a front handle extending therefrom and the rear panel comprises a rear handle extending therefrom. The front handle and the rear handle are in opposing relation to each other, the front handle and the rear handle extending over the first gusseted side panel.

Also disclosed herein is a process. In an embodiment, the process includes providing a flexible container comprising a front panel, a rear panel, a first gusseted side panel, and a second gusseted side panel. The gusseted side panels adjoin the front panel and the rear panel along peripheral seals to form a chamber. The panels form (i) a top portion comprising a neck and a fitment in the neck, (ii) a body portion, and (iii) a bottom portion. The top portion comprises a neck and a fitment in the neck. The front panel comprises a front handle extending therefrom and the rear panel comprises a rear handle extending therefrom. The front handle and the rear handle are in opposing relation to each other, the front handle and the rear handle extending over the first gusseted side panel. The process includes grasping the front handle and the rear handle and lifting the flexible container with the handles.

DEFINITIONS

Figure 1:
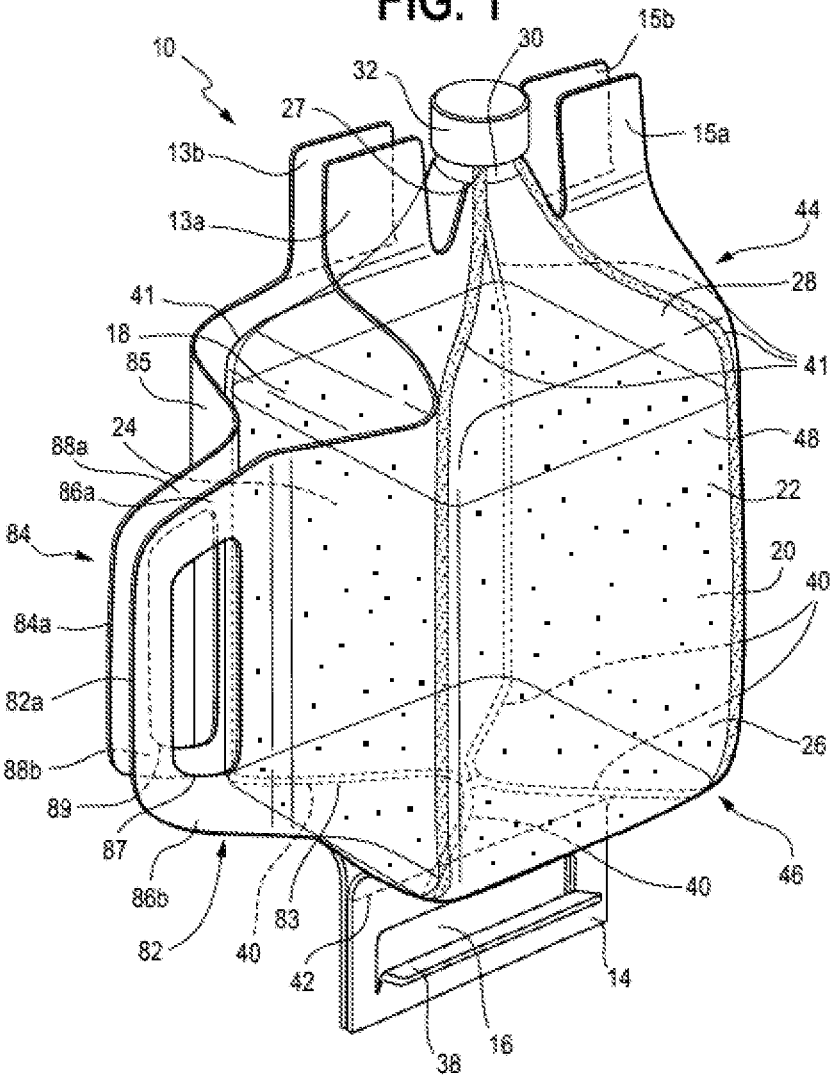
FIG. 1 is a perspective view of a flexible container with a front panel having a front handle and a rear panel having a rear handle in accordance with an embodiment of the present disclosure.

All references to the Periodic Table of the Elements herein shall refer to the Periodic Table of the Elements, published and copyrighted by CRC Press, Inc., 2003. Also, any references to a Group or Groups shall be to the Group or Groups reflected in this Periodic Table of the Elements using the IUPAC system for numbering groups.

For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges disclosed herein include all values from, and including, the lower value and the upper value. For ranges containing explicit values (e.g., a range from 1, or 2, or 3 to 5, or 6, or 7) any subrange between any two explicit values is included (e.g., the range 1-7 above includes subranges 1 to 2; 2 to 6; 5 to 7; 3 to 7; 5 to 6; etc.).

Unless stated to the contrary, implicit from the context, or customary in the art, all parts and percentages are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

An "ethylene-based polymer," as used herein is a polymer that contains more than 50 weight percent polymerized ethylene monomer (based on the total amount of polymerizable monomers) and, optionally, may contain at least one comonomer.

An "olefin-based polymer," as used herein is a polymer that contains more than 50 weight percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 weight percent polymerized propylene monomer (based on the total amount of polymerizable monomers) and, optionally, may contain at least one comonomer.

Test Methods

Density is measured in accordance with ASTM D792 with results reported in grams per cubic centimeter (g/cc).

Melt index (MI) is measured in accordance with ASTM D1238, Condition 190° C./2.16 kg with results reported in grams per 10 minutes (g/10 min).

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

DETAILED DESCRIPTION

The present disclosure provides a flexible container. The flexible container includes a front panel, a rear panel, a first gusseted side panel, and a second gusseted side panel. The gusseted side panels adjoin the front panel and the rear panel along peripheral seals to form a chamber. The panels form (i) a top portion, (ii) a body portion, and (iii) a bottom portion. The top portion includes a neck and a fitment in the neck. The front panel includes a front handle extending from the front panel. The rear panel includes a rear handle extending from the rear panel. The front handle and the rear handle are in opposing relation to each other. The front handle and the rear handle extend over the first gusseted side panel.

Figure 3:
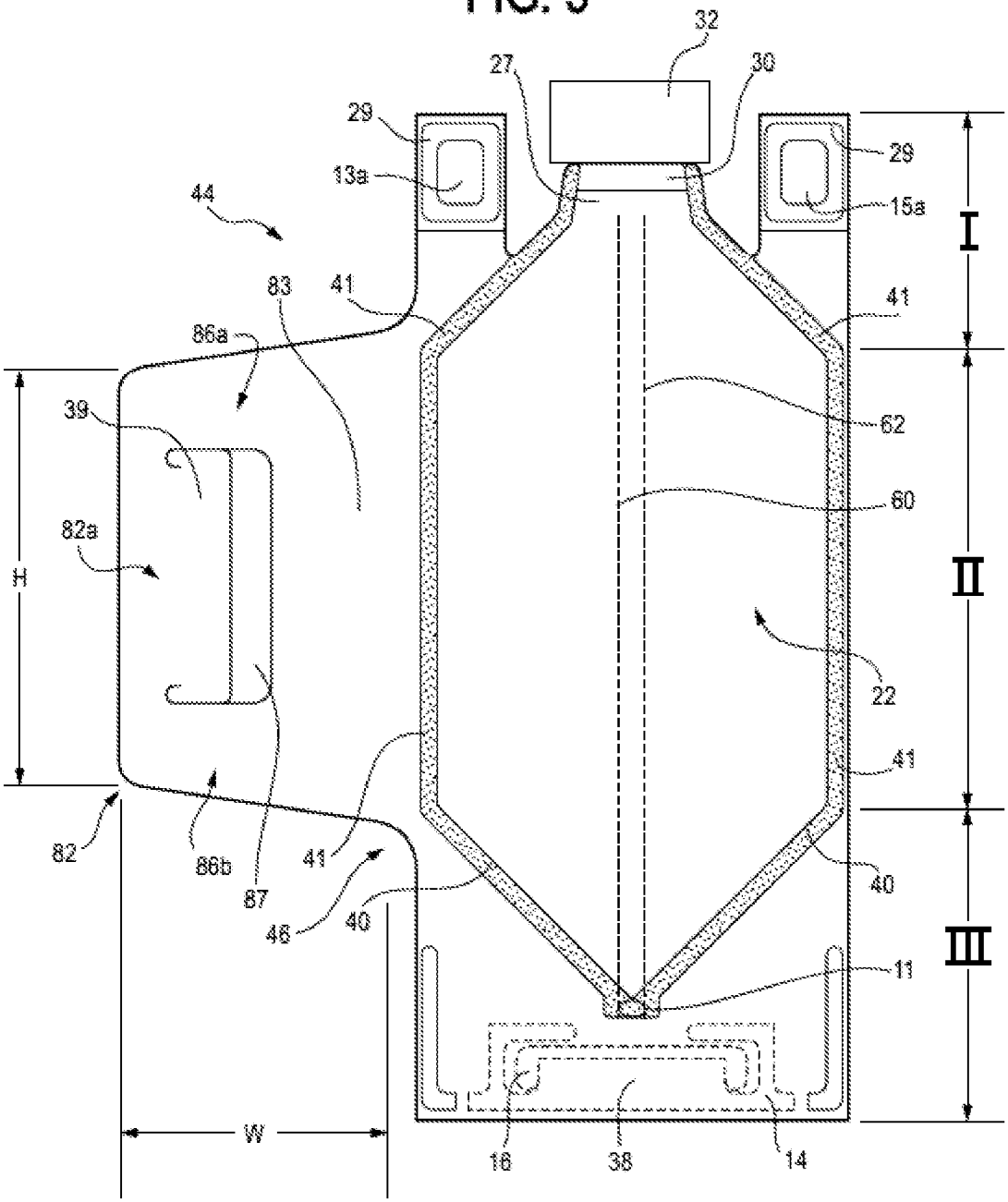
FIG. 3 is a top plan view of the flexible container of FIG. 1 in a collapsed configuration in accordance with an embodiment of the present disclosure.

FIGS. 1, 3-6 show a flexible container 10. The flexible container 10 has an expanded configuration (shown in FIGS. 1, 4-6) and has a collapsed configuration (shown in FIG. 3). The flexible container 10 has a top portion I, a body portion II, and a bottom portion III, as shown in FIG. 3.

The flexible container 10 has four panels. During the fabrication process, the panels are formed when one or more webs of film material are sealed together. In an embodiment, four webs of film material are sealed together to form the four panels. While the webs may be separate pieces of film material, it will be appreciated that any number of seams between the webs could be "pre-made," as by folding one or more of the source webs to create the effect of a seam or seams. For example, if it were desired to fabricate the present flexible container from two webs instead of four, the bottom, left center, and right center webs could be a single folded web, instead of three separate webs. Similarly, one, two, or more webs may be used to produce each respective panel (i.e., a bag-in-a-bag configuration or a bladder configuration).

Figure 2:
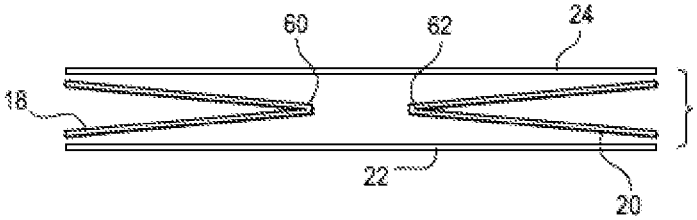
FIG. 2 is a side elevation view of a panel sandwich.

FIG. 2 shows the relative positions of the four webs as they form four panels (in a "one up" configuration) as they pass through the fabrication process. For clarity, the webs are shown as four individual panels, the panels separated and the seals not made. The constituent webs form a first gusseted side panel 18, a second gusseted side panel 20, a front panel 22, and a rear panel 24. Gusset fold lines 60 and 62 are shown in FIGS. 2 and 3.

As shown in FIG. 2, the folded gusseted side panels 18, 20 are placed between the rear panel 24 and the front panel 22 to form a "panel sandwich." The gusseted side panel 18 opposes the gusseted side panel 20. When the flexible container 10 is in the collapsed configuration, the flexible container is in a flattened state, or in an otherwise evacuated state. The gusseted side panels 18, 20 fold inwardly (dotted gusset fold lines 60, 62 of FIG. 3) and are sandwiched by the front panel 22 and the rear panel 24.

The four panels 18, 20, 22 and 24 each can be composed of a separate web of multilayer film. The composition and structure for each web of multilayer film can be the same or different. Alternatively, one web of multilayer film may also be used to make all four panels. In a further embodiment, two or more webs of multilayer film can be used to make each panel.

Multilayer Film

The flexible multilayer film used in construction of each panel of the flexible container 10 can comprise a food-grade plastic. For instance, nylon, polypropylene, polyethylene such as high density polyethylene (HDPE) and/or low density polyethylene (LDPE) may be used as discussed later. The flexible multilayer film can have a thickness that is adequate to maintain a flowable material and package integrity during manufacturing, distribution, product shelf life and customer usage. The film material can also be such that it provides the appropriate atmosphere within the flexible container 10 to maintain a product shelf life of at least about 180 days. The flexible multilayer film can comprise an oxygen barrier film having an oxygen transmission rate (OTR) that is reported in units of "cc/m$^2$/24 h/atm" and measured at 23° C. and 80% relative humidity (RH). In an embodiment, the flexible multilayer film has an OTR value from 0, or 0.2 to 0.4, or 1 cc/m$^2$/24 h/atm. In a further embodiment, the flexible multilayer film has an OTR value from 0 to 1, or from 0.2 to 0.4 cc/m$^2$/24 h/atm. Additionally, the flexible multilayer film can also comprise a water vapor barrier film having a water vapor transmission rate (WVTR) that is reported in units of "g/m$^2$/24 h" and measured at 38° C. and 90% RH. In an embodiment, the flexible multilayer film has a WVTR value from 0, or 0.2, or 1 to 5, or 10, or 15 g/m$^2$/24 h. In a further embodiment, the flexible multilayer film has a WVTR value from 0 to 15, or from 0.2 to 10, or from 1 to 5 g/m$^2$/24 h. Moreover, it may be desirable to use materials of construction having oil and/or chemical resistance particularly in the seal layer, but not limited to just the seal layer. The flexible multilayer film can be either printable or compatible to receive a pressure sensitive label or other type of label for displaying of indicia on the flexible container 10.

In an embodiment, each panel 18, 20, 22, 24 is made from a flexible multilayer film having at least one, or at least two, or at least three layers. The flexible multilayer film is resilient, flexible, deformable, and pliable. The structure and composition of the flexible multilayer film for each panel may be the same or different. For example, each of the four panels can be made from a separate web, each web having a unique structure and/or unique composition, finish, or print. Alternatively, each of the four panels can be the same structure and the same composition.

In an embodiment, each panel 18, 20, 22, 24 is a flexible multilayer film having the same structure and the same composition.

The flexible multilayer film may be (i) a coextruded multilayer structure, or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

Nonlimiting examples of suitable polymeric materials for the seal layer include olefin-based polymer (including any ethylene/$C_3$-$C_{10}$ $\alpha$-olefin copolymers linear or branched), propylene-based polymer (including plastomer and elastomer, random propylene copolymer, propylene homopolymer, and propylene impact copolymer), ethylene-based polymer (including plastomer and elastomer, high density polyethylene ("HDPE"), low density polyethylene ("LDPE"), linear low density polyethylene ("LLDPE"), medium density polyethylene ("MDPE"), ethylene-acrylic acid or ethylene-methacrylic acid and their ionomers with zinc, sodium, lithium, potassium, magnesium salts, ethylene vinyl acetate copolymers and blends thereof.

In an embodiment, the seal layer is a blend of an olefin-based polymer and a slip agent.

Nonlimiting examples of suitable olefin-based polymers for use in the seal layer blend include LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company)), propylene-based plastomers or elastomers such as VERSIFY™ (The Dow Chemical Company), and blends thereof.

A nonlimiting example of a suitable slip agent for use in the seal layer blend includes a fatty acid derivative. In an embodiment, the slip agent is an amide of a C18 to C24 fatty acid. In a further embodiment, the slip agent is an amide of a C22 mono-unsaturated fatty acid (e.g., erucamide)

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (BOPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6, Nylon 6,6, Nylon 6,66, Nylon 6,12, Nylon 12 etc.), polyethylene norbornene, cyclic olefin copolymers, polyacrylonitrile, polyesters, copolyesters (such as PETG), cellulose esters, polyethylene and copolymers of ethylene (e.g., LLDPE based on ethylene octene copolymer such as DOWLEX™, blends thereof, and multilayer combinations thereof.

Nonlimiting examples of suitable polymeric materials for the tie layer include functionalized ethylene-based polymers such as ethylene-vinyl acetate ("EVA"), polymers with maleic anhydride-grafted to polyolefins such as any polyethylene, ethylene-copolymers, or polypropylene, and ethylene acrylate copolymers such an ethylene methyl acrylate ("EMA"), glycidyl containing ethylene copolymers, propylene and ethylene based olefin block copolymers (OBC) such as INTUNE™ (PP-OBC) and INFUSE™ (PE-OBC) both available from The Dow Chemical Company, and blends thereof.

The flexible multilayer film may include additional layers which may contribute to the structural integrity or provide specific properties. The additional layers may be added by direct means or by using appropriate tie layers to the adjacent polymer layers. Polymers which may provide additional mechanical performance such as stiffness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN resins available from The Dow Chemical Company); vinylethylene vinyl alcohol (EVOH), metal foil (such as aluminum foil). Alternatively, modified polymeric films such as vapor deposited aluminum or silicon oxide on such films as BON, BOPET, or OPP, can be used to obtain barrier properties when used in laminate multilayer film.

In an embodiment, the flexible multilayer film has a thickness from 100 micrometers (μm), or 200 μm, or 250 μm to 300 μm, or 350 μm, or 400 μm. In a further embodiment, the flexible multilayer film has a thickness from 100 to 400 μm, or from 200 to 350 μm, or from 250 μm to 300 μm.

In an embodiment, the panels 18, 20, 22 and 24 are made of the same seven-layer film, with structure and composition set forth in Table 1 below.

TABLE 1

| Layer | Layer % | Layer composition |
|---|---|---|
| A | 10 | Dowlex 2038.68G (skin layer) |
| B | 15 | Innate ST50 |
| C | 15 | Innate ST50 |
| D | 10 | Innate ST50 |

TABLE 1-continued

| Layer | Layer % | Layer composition |
|---|---|---|
| E | 15 | Innate ST50 |
| F | 15 | Innate ST50 |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

In an embodiment, the panels 18, 20, 22 and 24 are made of the same seven-layer film, with structure and composition set forth in Table 2 below.

TABLE 2

| Layer | Layer % | Layer composition (skin layer) |
|---|---|---|
| A | 10 | Nylon 6/6, 6 |
| B | 10 | Tie layer |
| C | 30 | Innate ST50 |
| D | 10 | Tie layer |
| E | 10 | Nylon 6/6, 6 |
| F | 10 | Tie layer |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

In an embodiment, the panels 18, 20, 22 and 24 are made of the same seven-layer film, with structure and composition set forth in Table 3 below.

TABLE 3

| Layer | Layer % | Layer composition |
|---|---|---|
| A | 10 | Nylon 6/6, 6 (skin layer) |
| B | 10 | Tie layer |
| C | 30 | Innate ST50 |
| D | 10 | Tie layer |
| E | 10 | EVOH |
| F | 10 | Tie layer |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

In an embodiment, the panels 18, 20, 22 and 24 are made of the same seven-layer film, with structure and composition set forth in Table 4 below.

TABLE 4

| Layer | Layer % | Layer composition |
|---|---|---|
| A | 15 | Elite 5960G1 (skin layer) |
| B | 15 | Innate ST50 |
| C | 10 | Innate ST50 |
| D | 10 | Innate ST50 |
| E | 15 | Innate ST50 |
| F | 15 | Elite 5960G1 |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

Figure 4:
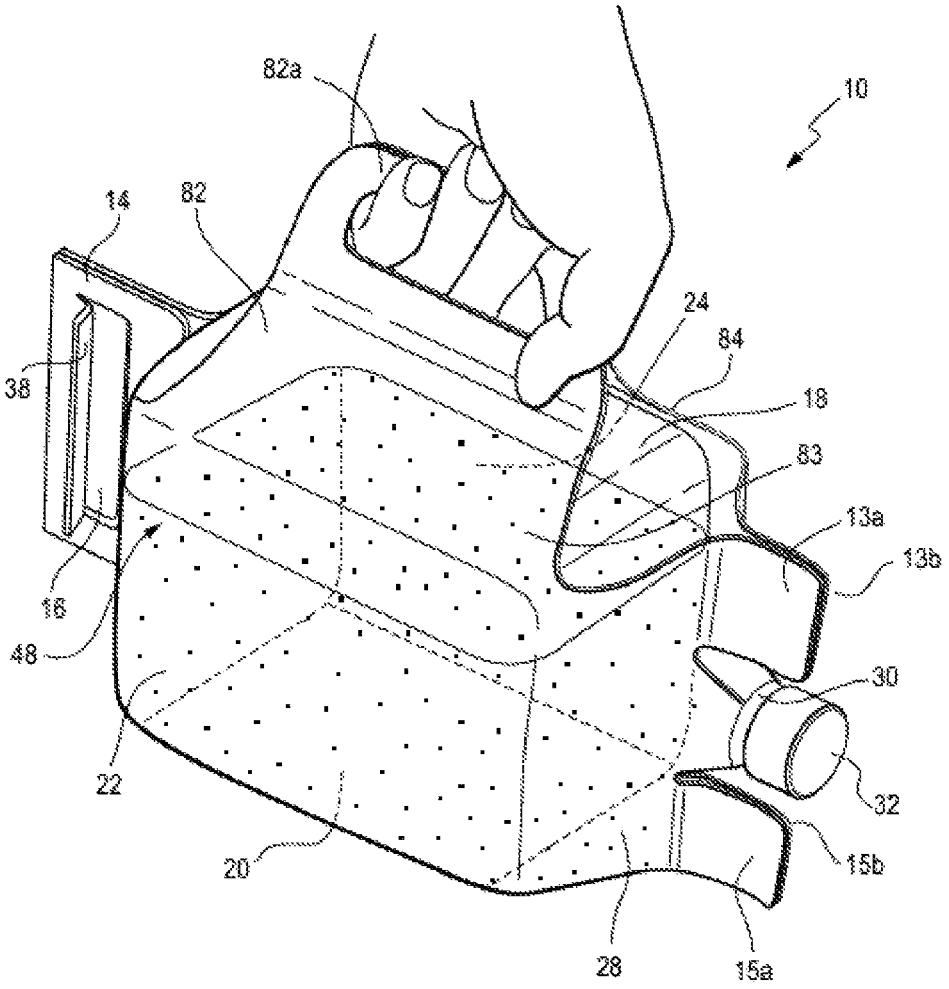
FIG. 4 is a perspective view of the flexible container of FIG. 1 being grasped by the front handle and the rear handle in accordance with an embodiment of the present disclosure.
Figure 6:
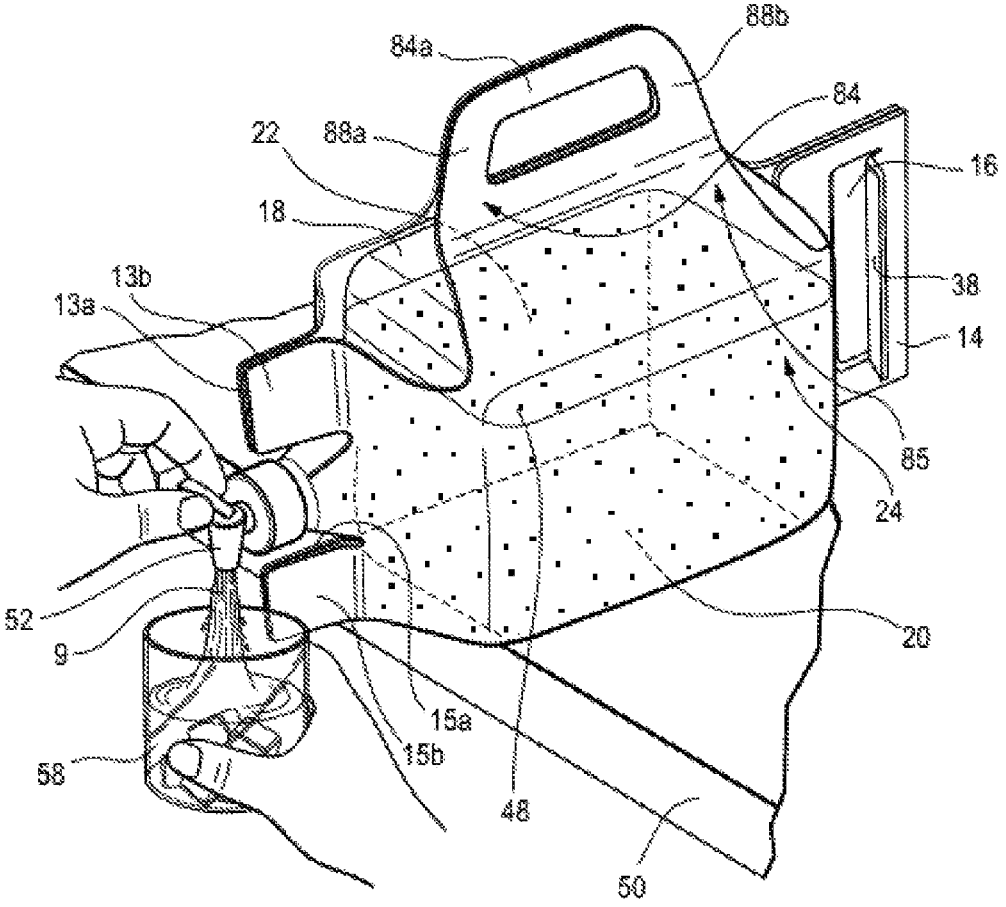
FIG. 6 is a perspective view of a flexible container with a spigot dispensing a flowable material in accordance with an embodiment of the present disclosure.

FIGS. 1, 4 and 6 show the flexible container 10 in the expanded configuration. The flexible container 10 has four panels 18, 20, 22 and 24. In an embodiment, the flexible container 10 includes one web of multilayer film for each respective panel 18, 20, 22, and 24. The gusseted side panels 18, 20 adjoin the front panel 22 and the rear panel 24 along peripheral seals 41 to form the body portion II, as shown in FIGS. 1 and 3. The peripheral seals 41 are located on the side edges of the flexible container 10. Four peripheral tapered seals 40 are located on the bottom portion III, as shown in FIGS. 1 and 3. An overseal 11 is formed where the four peripheral tapered seals 40 converge in a bottom end 46, as shown in FIG. 3. The overseal 11 includes an area where a portion of each panel (18, 20, 22, 24) is sealed to a portion of every other panel to form a 4-ply seal. The overseal 11 also includes an area where two panels (front panel 22 and rear panel 24) are sealed together. The term "overseal," as used herein, is the area where the peripheral tapered seals 40 converge and that is subjected to at least two sealing procedures, as described herein.

The four panels 18, 20, 22, 24 extend toward a top end 44 to form the top portion I and extend toward the bottom end 46 to form the bottom portion III of the flexible container 10, as shown in FIGS. 1 and 3. The top portion I forms a top segment 28 and the bottom portion III forms a bottom segment 26, as shown in FIG. 1. To form the top portion I and the bottom portion III, the four webs of film converge together at the respective end and are sealed together. For instance, the top segment 28 can be defined by four top panels that are extensions of the panels 18, 20, 22, 24 and are sealed together at the top end 44. The bottom segment 26 also can be defined by four bottom panels that are extensions of the panels 18, 20, 22, 24 and are sealed together at the bottom end 46. Nonlimiting examples of suitable methods for sealing the four webs of film together include ultrasonic sealing, heat sealing, impulse sealing, high frequency sealing, and combinations thereof. In an embodiment, the seal among the four webs of film is formed with a heat sealing procedure. The term "heat sealing procedure," as used herein, includes placing two or more films of polymeric material between opposing heat seal bars; moving the heat seal bars moved toward each other; sandwiching the films; and applying heat and pressure to the films such that opposing surfaces (seal layers) of the films contact, melt, and form a heat seal, or weld, to attach the films to each other. Heat sealing includes suitable structure and mechanism to move the seal bars toward and away from each other in order to perform the heat sealing procedure.

Top Portion

The top portion I includes a neck. In an embodiment, a portion of each of the four panels 18, 20, 22, 24 forms the top segment 28 and terminates at a neck 27, as shown in FIGS. 1 and 3. In this way, each panel extends from the bottom segment 26 to the neck 27. The neck 27 includes a fitment 30, as shown in FIGS. 1, 3-5. At the neck 27, a portion of a top end section of each of the four panels 18, 20, 22, 24 is sealed, or otherwise is welded, to the fitment 30 to form a tight seal. In an embodiment, the fitment 30 is sealed to the neck 27 with the heat sealing procedure, as described herein. Although the base of the fitment 30 has a circular cross-sectional shape, it is understood that the base of the fitment 30 can have other cross-sectional shapes such as a polygonal cross-sectional shape, for example. The base with circular cross-sectional shape is distinct from fitments with canoe-shaped bases used for conventional two-panel flexible pouches.

In an embodiment, an outer surface of the base of the fitment 30 has surface texture. The surface texture can include embossment and a plurality of radial ridges to promote sealing to the inner surface of the top segment 28.

The fitment 30 can generally be located anywhere on the top segment 28 of the flexible container 10. In an embodiment, the fitment 30 is positioned at a midpoint of the top segment 28 and can be sized smaller than a width of the flexible container 10, such that the fitment 30 can have an area that is less than a total area of the top segment 28. In a further embodiment, the fitment area is not more than 20% of the total top segment area. This can ensure that the fitment 30 will not be large enough to insert a hand therethrough, thus avoiding any unintentional contact with the flowable material 48 stored therein, as shown in FIGS. 1, 4 and 6.

In an embodiment, the fitment 30 is a spout. In a further embodiment, the fitment 30 is a threaded spout, as shown in FIGS. 5B-5E.

In an embodiment, the fitment 30 includes a closure. The closure covers the fitment 30 and prevents the flowable material 48 from spilling out of the flexible container 10. The closure can be a removable closure. Nonlimiting examples of a removable closure include a threaded cap and flip-top cap. In an embodiment, the removable closure is a threaded cap 32, as shown in FIGS. 1, 4 and 5A-5E.

In an embodiment, the closure is a dispensing closure. A nonlimiting example of a dispensing closure suitable for use includes a spigot. In an embodiment, the dispensing closure is a spigot 52, as shown in FIG. 6.

The fitment 30, the threaded cap 32, and the spigot 52 can be made of a rigid construction and can be formed of any appropriate plastic, such as high density polyethylene (HDPE), low density polyethylene (LDPE), polypropylene (PP), and combinations thereof.

Body Portion

The body portion II of the flexible container 10 includes a chamber. A flowable material 48 is stored inside of the chamber, as shown in FIGS. 1, 4 and 6. The flowable material is a material that can be transferred into and out of the flexible container 10. The term "flowable material," as used herein, is a liquid or a particulate solid material that is pourable from the chamber, through the fitment 30, and out of the flexible container 10.

In an embodiment, the flowable material 48 is a food product. Nonlimiting examples of food products suitable for storage within the chamber of the flexible container 10 include beverages such as water, juice, milk, syrup, carbonated beverages (beer, soft drinks), and fermented beverages (wine, scotch), salad dressings, sauces, dairy products, condiments (e.g., mayonnaise, mustard, ketchup), animal feed, and the like.

In an embodiment, the flowable material 48 is an industrial product. Nonlimiting examples of industrial products suitable for storage within the chamber of the flexible container 10 include oil, paint, grease, chemicals, cleaning solutions, washing fluids, suspensions of solids in liquid, and solid particulate matter (powders, grains, granular solids).

In an embodiment, the flowable material 48 is a squeezable product. The term "squeezable product," as used herein, is a flowable material (i) with a viscosity greater than the viscosity of water, and (ii) that requires application of a squeezing force to the flexible container 10 in order to discharge the material from the chamber. Nonlimiting examples of squeezable products suitable for storage within the chamber of the flexible container 10 include grease, butter, margarine, soap, shampoo, animal feed, sauces, baby food, and the like.

The chamber of the flexible container 10 has a volume. In an embodiment, the volume of the chamber of the flexible container 10 is from 0.25 liters (L), or 0.5 L, or 0.75 L, or 1 L, or 1.5 L, or 2.5 L, or 3 L, or 3.5 L, or 4 L, or 4.5 L, or 5 L to 6 L, or 7 L, or 8 L, or 9 L, or 10 L, or 20 L, or 30 L. In a further embodiment, the volume of the chamber of the flexible container 10 is from 0.25 to 30 L, or from 0.5 to 10 L, or from 3 to 8 L.

Bottom Portion

The bottom portion III includes a bottom handle 14, as shown in FIGS. 1, 4-6. The bottom handle 14 extends vertically, or substantially vertically, from the bottom segment 26 and, in particular, can extend from the four bottom panels that make up the bottom segment 26. The four bottom top panels of film that extend into the bottom handle 14 are all sealed together to form a multilayered bottom handle 14. In an embodiment, the four bottom panels come together at a midpoint of the bottom segment 26 and are sealed together with the heat sealing procedure, as described herein. The bottom handle 14 can comprise up to four layers of film (one layer for each panel 18, 20, 22, 24) sealed together when four webs of film are used to make the flexible container 10. Any portion of the bottom handle 14 where all four layers are not completely sealed together by the heat sealing procedure can be adhered together in any appropriate manner, such as by a tack seal to form a fully-sealed multilayered bottom handle 14. The bottom handle 14 can have any suitable shape and generally will take the shape of the film end. Oftentimes the web of film has a rectangular shape when unwound, such that its ends have a straight edge. Therefore, the bottom handle 14 would also have a rectangular shape.

The bottom handle 14 includes a bottom handle opening 16. The bottom handle opening 16 can be any shape that is convenient to fit the hand and, in one embodiment, the bottom handle opening 16 can have a generally rectangular shape. In another embodiment, the bottom handle opening 16 can have a generally oval shape. Additionally, the bottom handle opening 16 can include a flap 38, as shown in FIGS. 1, 3-6. The flap 38 comprises material that is cut from the bottom handle 14 to form the bottom handle opening 16. To define the bottom handle opening 16, the bottom handle 14 can have a section that is cut out along three sides, or three portions, while remaining attached at a fourth side, or fourth portion. In an embodiment, a lower side, or a lower portion, of the flap 38 can remain attached to the bottom handle 14, as shown in FIG. 1. This provides the flap 38 that can be pushed through the bottom handle opening 16 by the user and folded over an edge of the bottom handle opening 16. In an embodiment, the flap 38 folds downwards and away from the flexible container 10 to create a smooth gripping surface of the bottom handle 14, such that the handle material is not sharp and can protect the user's hand from getting cut on any sharp edges of the bottom handle 14.

In an embodiment, the bottom handle 14 can be a "punch-out handle," that is a handle formed by a process that cuts, or otherwise "punches" film material from the bottom 14, thereby removing film material from the flexible container 10. The punch-out handle does not have, or is otherwise void of, a flap.

In an embodiment, a portion of the bottom handle 14 attached to the bottom segment 26 includes a machine fold 42, (or score line), as shown in FIG. 1, that provides for the bottom handle 14 to consistently fold in the same direction.

Figure 5A:
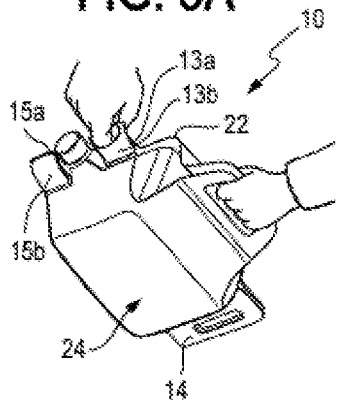
FIG. 5A is a perspective view of the flexible container of FIG. 4 being lifted in accordance with an embodiment of the present disclosure.
Figure 5B:
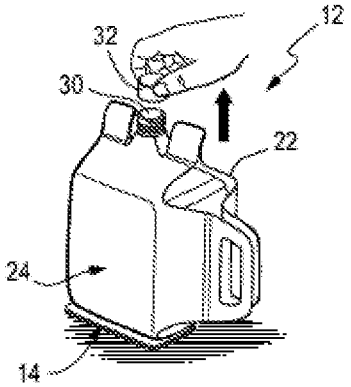
FIG. 5B is a perspective view of removal of a closure to open the flexible container of FIG. 5A in accordance with an embodiment of the present disclosure.
Figure 5C:
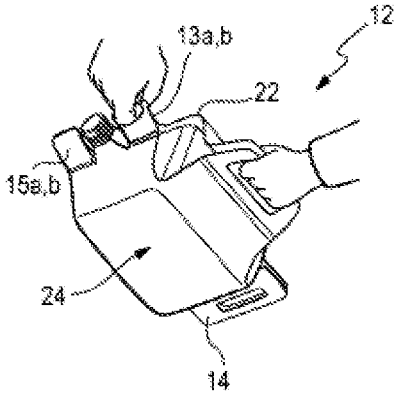
FIG. 5C is a perspective view of the open container of FIG. 5B being lifted in accordance with an embodiment of the present disclosure.
Figure 5D:
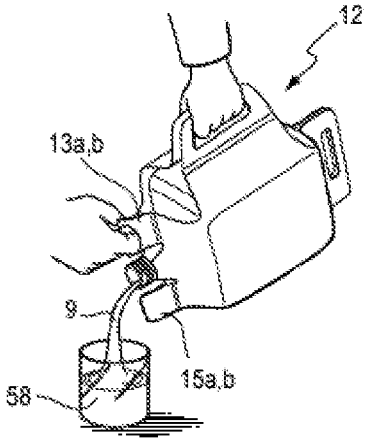
FIG. 5D is a perspective view of the open container of FIG. 5B dispensing a flowable material in accordance with an embodiment of the present disclosure.
Figure 5E:
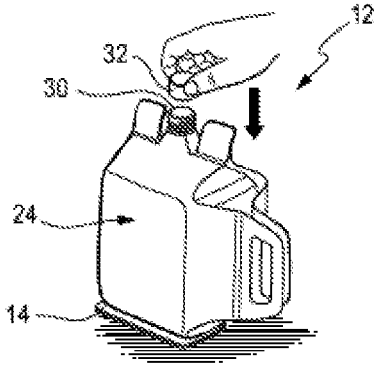
FIG. 5E is a perspective view of a replacement of the closure to close the flexible container of FIG. 5B in accordance with an embodiment of the present disclosure.

The machine fold 42 can comprise a fold line that facilitates folding toward the rear panel 24 and limits folding toward the front panel 22. The machine fold 42 can allow for the bottom handle 14 to be inclined to fold or bend consistently toward the rear panel 24, as shown in FIGS. 5B and 5E. The machine fold 42 can cause the bottom handle 14 to consistently fold toward the rear panel 24 because it provides a generally permanent fold line in the bottom handle 14 that is predisposed to fold toward the rear panel 24, rather than toward the front panel 22. The machine fold 42 can be located below the bottom segment 26 of the flexible container 10 at a location where the seal begins, as shown in FIG. 1. The bottom handle 14 can be adhered together, such as with a tack adhesive, beginning from an area of the bottom handle 14 that includes the machine fold 42. When the flexible container 10 is stored in an upright position, the machine fold 42 encourages the bottom handle 14 to fold along the machine fold 42 such that the bottom handle 14 can fold underneath the flexible container 10, as shown in FIGS. 5B, 5E. The weight of the flowable material 48 can also apply a force to the bottom handle 14, such that the weight of the flowable material 48 can further press on the bottom handle 14 and maintain the bottom handle 14 in the folded position in the first direction.

The bottom handle 14 is disposed in a position. Positions of the bottom handle 14 include a storage position and an open position. As shown in FIGS. 5B and 5E, the bottom handle 14 has the storage position when the flexible container 10 is stored in an upright position on the bottom segment 26. The bottom handle 14 has the storage position when the flexible container 10 is being shipped, stored and displayed for sale, for example. As shown in FIGS. 1, 4, 5A, 5C, 5D and 6, the bottom handle 14 has the open position when the flexible container 10 is lifted, carried and dispensing the flowable material 48, for example.

Front and Rear Handles

The flexible container 10 includes a front handle 82 and a rear handle 84, as shown in FIGS. 1, 3-6. The front handle 82 extends horizontally, or substantially horizontally, from the front panel 22 and, in particular, can extend from the body portion II of the flexible container 10. The multilayer film that provides the front panel 22 extends into the front handle 82 and extends through the peripheral seal 41, as shown in FIG. 1. In an embodiment, the front handle 82 is integral with the front panel 22. The term "integral," as used herein, indicates that the front handle 82 and the front panel 22 are subcomponents of a single unitary component and are constructed from the same multilayer film.

In an embodiment, the rear handle 84 is integral with the rear panel 24. The rear handle 84 extends horizontally, or substantially horizontally, from the rear panel 24 and, in particular, can extend from the body portion II of the flexible container 10. The multilayer film that provides the rear panel 24 extends into the rear handle 84 and extends through the peripheral seal 41, as shown in FIG. 1.

The front handle 82 and the rear handle 84 are in opposing relation to each other, as shown in FIG. 1. In an embodiment, the front handle 82 and the rear handle 84 are superimposable upon each other and are mirror images of each other.

The front handle 82 and the rear handle 84 extend over the first gusseted side panel 18, as shown in FIGS. 1, 4 and 6. The extension of the front handle 82 and the rear handle 84 is contained over the first gusseted side panel 18. The front handle 82 and the rear handle 84 of the flexible container 10 do not extend over one, or any, of the second gusseted side panel 20, the top segment 28, and the bottom segment 26. The front handle 82 and the rear handle 84 extend over the first gusseted side panel 18 to the exclusion of the front handle 82 and the rear handle 84 extending over the fitment 30. Although FIGS. 1, 4-6 show the front handle 82 and the rear handle 84 extending over the first gusseted side panel 18, it is understood the flexible container 10 may be configured and fabricated so that the front handle 82 and the rear handle 84 extend over the second gusseted side panel 20.

The front handle 82 includes a front flange 83 and an outer front handle 82*a*, as shown in FIGS. 1 and 3. The outer front handle 82*a* can have a D-shape, or a reverse D-shape, and includes a pair of spaced front arms 86*a*, 86*b* extending therefrom. The front arms 86*a*, 86*b* extend horizontally, or substantially horizontally, from the front flange 83. In an embodiment, each of the outer front handle 82*a*, the front arms 86*a*, 86*b*, and the front flange 83 are integral with each other, i.e., components 82*a*, 86*a*, 86*b*, and 83 are subcomponents of a single unitary component and are constructed from the same multilayer film.

The rear handle 84 includes a rear flange 85 and an outer rear handle 84*a*, as shown in FIG. 1. The outer rear handle 84*a* can have a D-shape, or a reverse D-shape, and includes a pair of spaced rear arms 88*a*, 88*b* extending therefrom. The rear arms 88*a*, 88*b* extend horizontally, or substantially horizontally, from the rear flange 85. In an embodiment, each of the outer rear handle 84*a*, the rear arms 88*a*, 88*b*, and the rear flange 85 are integral with each other, i.e., components 84*a*, 88*a*, 88*b*, and 85 are subcomponents of a single unitary component and are constructed from the same multilayer film.

The flexible container 10 includes a front handle opening 87 and a rear handle opening 89, as shown in FIGS. 1 and 3. The front handle opening 87 and the rear handle opening 89 are surrounded by the outer front handle 82*a* and the outer rear handle 84*a*, respectively. The term "openings," as used herein, is the pair of the front handle opening 87 and the rear handle opening 89. Each of the openings is sized to fit a user's hand. The openings can have any shape that is convenient to fit the hand. In an embodiment, the openings have a generally oval shape, as shown in FIG. 1. In a further embodiment, the openings have a generally rectangular shape. In an embodiment, either of the front handle 82 and the rear handle 84 is a "punch-out handle," that is an opening formed by a process that cuts, or otherwise "punches", film material from the front handle 82 or the rear handle 84, thereby removing film material from the flexible container 10. The punch-out handle does not have, or is otherwise void of, a flap. The peripheral edges of the openings of the punch-out handle are smooth and void of sharp edges that can puncture, or otherwise injure, the user's hand.

In an embodiment, either of the openings is a cutout section and includes a flap that comprises the cut material that forms each of the openings. For example, the front handle 82 includes a flap 39 as shown in FIG. 3.

In an embodiment, the front handle 82 and the rear handle 84 are sealed together, as shown in FIG. 6. The front handle 82 and the rear handle 84 can be sealed together using the heat sealing procedure as described herein. In an embodiment, a seal between the front handle 82 and the rear handle 84 forms a common edge around a periphery of the front handle 82 and the rear handle 84, as shown in FIGS. 1, 4, 6. The seal between the front handle 82 and the rear handle 84 disposes the front handle 82 and the rear handle 84 in a position that is lateral from the flexible container 10.

In an embodiment, the seal between the front handle 82 and the rear handle 84 encompasses the entire D-shaped areas of the outer front handle 82*a* and the outer rear handle 84*a*. In a further embodiment, the seal between the front handle 82 and the rear handle 84 is formed only between a distal end of the outer front handle 82*a* and a distal end of the outer rear handle 84*a*.

The front handle 82 includes a height H, as shown in FIG. 3. The height H has a length that is from 1.0 to 1.2 times a length of the body section II, as shown in FIG. 3. In an embodiment, the height H of the front handle 82 is from 4 centimeters (cm), or 6 cm, or 8 cm, or 10 cm, or 12 cm to 14 cm, or 16 cm, or 18 cm, or 20 cm. In a further embodiment, the height H of the front handle 82 is from 4 to 20 cm, or from 8 to 18 cm, or from 10 to 16 cm.

In a manner identical to the front handle 82, the rear handle 84 has a height that is not shown. The height of the rear handle 84 has a length that is from 1.0 to 1.2 times the length of the body section II, as shown in FIG. 3. In an embodiment, the height of the rear handle 84 is from 4 cm, or 6 cm, or 8 cm, or 10 cm, or 12 cm to 14 cm, or 16 cm, or 18 cm, or 20 cm. In a further embodiment, the height of the rear handle 84 is from 4 to 20 cm, or from 8 to 18 cm, or from 10 to 16 cm.

The front handle 82 has a width W, as shown in FIG. 3. The width W has a length that is from 0.5 to 1.0 times the length of the body section II, as shown in FIG. 3. In an embodiment, the width W of the front handle 82 is from 4 centimeters (cm), or 6 cm, or 8 cm to 10 cm, or 12 cm, or 14 cm, or 16 cm, or 18 cm, or 20 cm. In a further embodiment, the width W of the front handle 82 is from 4 to 20 cm, or from 6 to 16 cm, or from 6 to 10 cm.

In a manner identical to the front handle 82, the rear handle 84 has a width that is not shown. The width of the rear handle 84 has a length that is from 0.5 to 1.0 times the length of the body section II, as shown in FIG. 3. In an embodiment, the width of the rear handle 84 is from 4 cm, or 6 cm, or 8 cm to 10 cm, or 12 cm, or 14 cm, or 16 cm, or 18 cm, or 20 cm. In a further embodiment, the width of the rear handle 84 is from 4 to 20 cm, or from 6 to 16 cm, or from 6 to 10 cm.

Tabs

The front panel 22 includes one or more front tabs and the rear panel 24 includes one or more rear tabs. In an embodiment, the front panel 22 includes front tabs 13*a* and 15*a* and the rear panel 24 includes rear tabs 13*b* and 15*b*, as shown in FIGS. 1, 3-6. The front tabs 13*a*, 15*a* and the rear tabs 13*b*, 15*b* extend vertically, or substantially vertically, from the top segment 28 of the flexible container 10 and, in particular, can extend from the panels 18, 20, 22, 24 that are sealed together to form the top segment 28. The panels (18, 20, 22, 24) that extend into the front tabs 13*a*, 15*a* and the rear tabs 13*b*, 15*b* are sealed together to form the front tabs 13*a*, 15*a* and the rear tabs 13*b*, 15*b*. In an embodiment, two, three or four of the panels 18, 20, 22, 24 are sealed together to form the front tabs 13*a*, 15*a* and the rear tabs 13*b*, 15*b*.

Each of the front tabs 13*a*, 15*a* and the rear tabs 13*b*, 15*b* include a respective proximate end and a respective distal end. The proximate ends of the front tabs 13*a*, 15*a* and the proximate ends of the rear tabs 13*b*, 15*b* are adjacent to the top segment 28, as shown in FIG. 1. The distal ends of the front tabs 13*a*, 15*a* and the distal ends of the rear tabs 13*b*, 15*b*, respectively, are located on an end of the tab opposite the respective proximate ends. The front tabs 13*a*, 15*a* and the rear tabs 13*b*, 15*b* are adjacent to the neck 27, as shown in FIGS. 1 and 3. The distal ends of the front tabs 13*a*, 15*a* and the distal ends of the rear tabs 13*b*, 15*b* are below an uppermost edge of the fitment 30. The distal ends of the front tabs 13*a*, 15*a* and the distal ends of the rear tabs 13*b*, 15*b* do not extend above the uppermost edge of the fitment 30, as shown in FIGS. 1 and 3. The uppermost edge of the fitment 30 extends above, or otherwise exceeds the length of, the distal ends of the front tabs 13*a*, 15*a* and the distal ends of the rear tabs 13*b*, 15*b*, as shown in FIGS. 1 and 3.

The front tab 13*a* and the rear tab 13*b* together form a tab pair 13. Each tab of the tab pair 13 is in opposing relation to the other, as shown in FIGS. 1, 4-6. Likewise, the front tab 15*a* and the rear tab 15*b* together form a tab pair 15 and each tab of the tab pair 15 is in opposing relation to the other. In an embodiment, each tab of the tab pair 13 is superimposable upon the other and each tab of the tab pair 15 is superimposable upon the other.

In an embodiment, the front tab 13*a* and the rear tab 13*b* can be sealed together to form the tab pair 13 and the front tab 15*a* and the rear tab 15*b* can be sealed together to form the tab pair 15, as shown in FIGS. 4-6. Each of the tab pair 13 and the tab pair 15 includes a tab seal 29, as shown in FIG. 3. The tab seals 29 can be formed using the heat sealing procedure, as described herein. In an embodiment, the tab seals 29 form a common edge around a periphery of the tab pair 13 and the tab pair 15, as shown in FIGS. 4-6.

In an embodiment, the tabs 13*a*-15*b* have a square shape, as shown in FIGS. 1, 3-6. In a further embodiment, the distal ends of the tabs 13*a*-15*b* have a round or circular shape. The tabs 13*a*-15*b* are sized to fit in between the thumb and forefinger of a user's hand, as shown in FIGS. 5A, 5C and 5D.

Process

The present disclosure provides a process. The process includes providing a flexible container. The flexible container includes a front panel, a rear panel, a first gusseted side panel, and a second gusseted side panel. The gusseted side panels adjoin the front panel and the rear panel along peripheral seals to form a chamber. The panels form (i) a top portion, (ii) a body portion, and (iii) a bottom portion. The top portion includes a neck and a fitment in the neck. The front panel includes a front handle extending from the front panel. The rear panel includes a rear handle extending from the rear panel. The front handle and the rear handle are in opposing relation to each other. The front handle and the rear handle extend over the first gusseted side panel.

The process includes grasping the flexible container 10. The flexible container 10 is grasped by the front handle 82 and the rear handle 84, as shown in FIGS. 4, 5A and 5C. The term "the handles," as used herein, is the front handle 82 and the rear handle 84. In an embodiment, the flexible container 10 can be grasped by the handles and by the bottom handle 14 simultaneously. In a further embodiment, the flexible container 10 can be grasped by the bottom handle 14 only.

The process includes lifting the flexible container 10. The flexible container 10 is lifted with the handles. In an embodiment, the tab pair 13 can be grasped as the flexible container 10 is lifted with the handles, as shown in FIG. 5A. The proximity of the handles to the tab pair 13 provides for convenient lifting of the flexible container 10. In an embodiment, the tab pair 15, or the bottom handle 14, can be grasped as the flexible container 10 is lifted with the handles.

The process includes carrying the flexible container 10. The flexible container 10 is carried with the handles, as shown in FIG. 4. A user can walk among two or more locations while carrying the flexible container 10 with the handles. In an embodiment, the tab pair 13 can be grasped as the flexible container 10 is carried with the handles. In an embodiment, the tab pair 15 or the bottom handle 14, can be grasped as the flexible container 10 is carried with the handles. The flexible container 10 can be lowered onto a support surface as the flexible container 10 is grasped with the handles. As shown in FIG. 5B, the flexible container 10 is placed in an upright position. The machine fold 42 encourages the bottom handle 14 to fold toward the rear panel 24 as the bottom handle 14 folds underneath the flexible container 10. When the flexible container 10 is in the upright position the threaded cap 32 is removed to place the flexible container 10 in a dispensing state, as shown in FIG. 5B. The term "open flexible container," as used herein, is the flexible container 10 with the threaded cap 32 removed from the fitment 30.

The process includes dispensing the flowable material. An open flexible container 12 can be lifted with the handles, as shown in FIG. 5C. In an embodiment, the tab pair 13 can be grasped as the open flexible container 12 is lifted with the handles. While grasping the handles of the open flexible container 12, the flowable material 48 is dispensed, as shown in FIG. 5D. The flowable material 48 is dispensed from the chamber of the open flexible container 12 and through the fitment 30 as a flowing material 9. In an embodiment, the tab pair 13 is grasped during the dispensing to provide for control of the flowing material 9. In this manner, spillage of the flowing material 9 is avoided as the flowing material 9 enters the container 58.

In an embodiment, the container 58 is a container, such as a glass, for example.

The open flexible container 12 is lowered onto the support surface and returned to the upright position, as shown in FIG. 5E. The term "upright position," as used herein, is an orientation whereby the fitment/closure is the uppermost component of the flexible container 10. In other words, when the flexible container 10 is in the upright position, the flexible container 10 rests on the bottom end 46 (and on the bottom handle 14), when placed on a support surface. The threaded cap 32 is secured onto the fitment 30 of the open flexible container 12.

In an embodiment, the fitment of the flexible container 10 incudes a spigot 52, as shown in FIG. 6. The process includes lowering the flexible container 10 onto a support surface 50 while grasping the handles. The second gusseted side panel 20 of the flexible container 10 is placed on the support surface 50, as shown in FIG. 6. The user operates the spigot 52 while holding the container 58 to capture the flowing material 9. The spigot 52 extends, horizontally, beyond the distal ends of the tab pair 15, as shown in FIG. 6. In this manner, the tab pair 15 does not interfere with dispensing of the flowing material 9 from the chamber.

By way of example, and not by limitation, some embodiments of the disclosure will now be described in detail in the following Examples.

Examples

The raw materials used to prepare the individual film layers of the multilayer films are provided in Table 5 below.

TABLE 5

| Polymer | Melt Index | Density | Supplier |
|---|---|---|---|
| Dowlex 2038.68G | 1.0 | 0.935 | Dow Inc. |
| Innate ST50 | 0.85 | 0.918 | Dow Inc. |
| Affinity 1146G | 1.0 | 0.899 | Dow Inc. |
| Antiblock 20% silica, 80% LDPE | NA | NA | Ampacet |
| Erucamide 5% Slip, 95% LDPE | NA | NA | Ampacet |
| Ultramid ® C33 (Nylon 6/66) | | | BASF |
| Tie Layer | Blend = 0.95 | TY 1057H = | Dow Inc. |

TABLE 5-continued

| Polymer | Melt Index | Density | Supplier |
|---|---|---|---|
| 15% Amplify TY 1057H 85% Innate ST50 | TY 1057H = 3.0 ST50 = 0.85 | 0.912 | |
| EVOH EVAL H171B | 1.7 | 1.17 | Kuraray |
| Elite 5960G1 | 0.85 | 0.962 | Dow Inc. |

The structure of Film 1 used to produce the flexible containers is provided in Table 6 below.

TABLE 6

| Layer | Layer % | Layer composition |
|---|---|---|
| A | 10 | Dowlex 2038.68G (skin layer) |
| B | 15 | Innate ST50 |
| C | 15 | Innate ST50 |
| D | 10 | Innate ST50 |
| E | 15 | Innate ST50 |
| F | 15 | Innate ST50 |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

The multilayer film is fabricated using a 7-layer Alpine blown film line and has an A/B/C/D/E/F/G structure. Layer "A" is the outer (i.e., skin) layer and layer "G" is the seal layer.

The "Layer %" value in Table 6 is the proportion of each layer in the multilayer film. The thickness of each layer is determined by multiplying the "Layer %" value by the total thickness of the multilayer film.

The total thickness of the multilayer film is 200 microns.

The 7-layer film of Table 6 is used to produce a four panel flexible container 10 with a front handle and a rear handle, as shown in FIGS. 1, 4-6.

It is specifically intended that the present disclosure not be limited to the embodiments and illustrations contained herein, but include modified forms of those embodiments including portions of the embodiments and combinations of elements of different embodiments as come with the scope of the following claims.

What is claimed is:

1. A flexible container comprising:

a front panel, a rear panel, a first gusseted side panel, and a second gusseted side panel, the gusseted side panels adjoining the front panel and the rear panel along peripheral seals to form a chamber, the panels forming (i) a top portion comprising a neck and a fitment in the neck, (ii) a body portion, and (iii) a bottom portion;

the front panel comprising a front handle extending therefrom and a front tab adjacent the neck;

the rear panel comprising a rear handle extending therefrom and a rear tab adjacent the neck;

the front handle and the rear handle are in opposing relation to each other, the front handle and the rear handle (i) extending over the first gusseted side panel and (ii) not extending over the fitment; and the front tab and the rear tab are in opposing relation to each other; and a first integral heat seal adjoins the front tab to the rear tab forming a tab seal, the tab seal forming a common edge around an entire periphery of the front tab and the rear tab and a second integral heat seal adjoins the front handle to the rear handle.

2. The flexible container of claim 1 wherein the front handle and the rear handle each has a vertical handle portion, the front handle sealed to the rear handle along the respective vertical handle portions.

3. The flexible container of claim 1 wherein the bottom portion comprises a bottom handle.

4. The flexible container of claim 1 wherein each panel is a flexible multilayer film.

5. A process comprising:

providing a flexible container comprising a front panel, a rear panel, a first gusseted side panel, and a second gusseted side panel, the gusseted side panels adjoining the front panel and the rear panel along peripheral seals to form a chamber, the panels forming (i) a top portion comprising a neck and a fitment in the neck, (ii) a body portion, and (iii) a bottom portion;

the front panel comprising a front handle extending therefrom and a front tab adjacent the neck, the rear panel comprising a rear handle extending therefrom and a rear tab adjacent the neck, and the front handle and the rear handle are in opposing relation to each other, the front handle and the rear handle (i) extending over the first gusseted side panel and (ii) not extending over the fitment, the front tab and the rear tab are in opposing relation to each other, and a first integral heat seal adjoins the front tab to the rear tab forming a tab seal, the tab seal forming a common edge around an entire periphery of the front tab and the rear tab, and a second integral heat seal adjoins the front handle to the rear handle;

grasping the front handle and the rear handle; and lifting the flexible container with the handles.

6. The process of claim 5 comprising, carrying, with the handles, the flexible container.

7. The process of claim 5 wherein the body portion comprises a chamber and a flowable material is in the chamber the process comprising dispensing the flowable material from the chamber and through fitment.

8. The process of claim 7 wherein the front tab and the rear tab form a tab pair, the process comprising grasping, during the dispensing, the tab pair.

9. The process of claim 8 comprising controlling, with the grasping of the tab pair, the dispensing of the flowable material.

10. The flexible container of claim 1 wherein the front handle and the rear handle each has a height H, height H having a length that is from 1.0 to 1.2 times the length of the body portion.

11. The flexible container of claim 1 wherein the front handle and the rear handle each has a width W, width W having a length that is from 0.5 to 1.0 times the length of the body portion.

12. The flexible container of claim 1 wherein each tab has a distal end and the tab distal ends do not extend above an uppermost edge of the fitment.

13. The flexible container of claim 1 wherein the front handle and the rear handle extend over the first gusseted side panel to the exclusion of the front handle and the rear handle extending over the fitment.

14. The flexible container of claim 1 wherein the front handle and the rear handle extend from the body portion of the container to the exclusion of the front handle and the rear handle extending from the top portion of the container.

15. The flexible container of claim 14 wherein the front handle and the rear handle extend from the body portion of the container to the exclusion of the front handle and the rear handle extending from the bottom portion of the container.

16. The flexible container of claim 3, wherein the bottom handle extends from the bottom portion to form a 90 degree angle between the bottom handle and the front handle.

17. The flexible container of claim 1, further comprising a cutout having a perimeter and formed through the front handle and the rear handle; and the integral heat seal adjoins the front handle and the rear handle along the entire perimeter of the cutout.

18. The flexible container of claim 17, wherein the cutout is D-shaped.

19. The flexible container of claim 1 wherein the front tab and rear tab form a first tab pair, the flexible container comprising a second front tab and a second rear tab in opposing relation to each other, the second front tab and the second rear tab forming a second tab pair, wherein the fitment is located between the first tab pair and the second tab pair.

20. The flexible container of claim 19 wherein a third integral heat seal adjoins the second front tab to the second rear tab forming a second tab seal, the second tab seal forming a second common edge around an entire periphery of the second front tab and the second rear tab.

21. The flexible container of claim 1, wherein the front handle and the rear handle extend horizontally from the body portion and not extending over the second gusseted side panel, the top portion and the bottom portion.

* * * * *